US008418460B2

(12) United States Patent
Ehrhard

(10) Patent No.: US 8,418,460 B2
(45) Date of Patent: Apr. 16, 2013

(54) EXHAUST GAS TURBOCHARGER FOR AN INTERNAL COMBUSTION ENGINE

(75) Inventor: Jan Ehrhard, Wiesloch (DE)

(73) Assignee: IHI Charging Systems International GmbH, Heidelberg (DE)

( * ) Notice: Subject to any disclaimer, the term of this patent is extended or adjusted under 35 U.S.C. 154(b) by 599 days.

(21) Appl. No.: 12/655,071

(22) Filed: Dec. 22, 2009

(65) Prior Publication Data

US 2010/0154415 A1 Jun. 24, 2010

Related U.S. Application Data

(63) Continuation-in-part of application No. PCT/EP2008/004807, filed on Jun. 14, 2008.

(30) Foreign Application Priority Data

Jun. 23, 2007 (DE) ..... 10 2007 029 004

(51) Int. Cl.
*F02D 23/00* (2006.01)

(52) U.S. Cl.
USPC ..... 60/602; 415/164

(58) Field of Classification Search ..... 60/602; 415/157–158, 159–165, 186, 208.3–208.5
See application file for complete search history.

(56) References Cited

U.S. PATENT DOCUMENTS 6,558,117 B1 * 5/2003 Fukaya et al. ..... 415/164
6,742,986 B2 * 6/2004 Osako et al. ..... 415/163
7,533,529 B2 * 5/2009 Stilgenbauer ..... 60/602
2003/0039543 A1 * 2/2003 Osako et al. ..... 415/150
2009/0022580 A1 * 1/2009 Hall ..... 415/160

FOREIGN PATENT DOCUMENTS

| | | |
|---|---|---|
| DE | 103 25 985 | 12/2004 |
| DE | 10 2005 001 864 | 1/2006 |
| EP | 1 099 838 | 5/2001 |
| EP | 1 394 364 | 3/2004 |
| EP | 1 528 225 | 5/2005 |
| JP | 06-30442 | 4/1994 |
| JP | 2001234752 A * | 8/2001 |
| WO | WO 00/71873 | 11/2000 |
| WO | WO 2007/046798 | 4/2007 |

OTHER PUBLICATIONS

Translation of JP-2001-234752.*
JP-2001-234752 Machine Translated on Jun. 15, 2012.*

* cited by examiner

*Primary Examiner* — Thomas Denion
*Assistant Examiner* — Patrick Maines
(74) *Attorney, Agent, or Firm* — Klaus J. Bach

(57) ABSTRACT

In an exhaust gas turbocharger for an internal combustion engine, comprising a turbine rotor, which is rotatably housed in a rotor chamber through which exhaust gas coming from the internal combustion engine is conducted and wherein the flow around the turbine rotor is conditioned by means of a guide apparatus comprising a support ring with rotatably mounted guide vanes. For fixing a first distance (A) between the support ring and the contour sleeve, at least one spacer element with a longitudinal axis, an outer surface and a cross-sectional area is provided so as to have a streamlined shape forming in the exhaust gas flow only a relatively narrow wake line and the spacer element is so arranged that the wake line formed thereby extends essentially through a flow space between two adjacent guide vanes without disturbing the exhaust gas flow around these guide vanes.

10 Claims, 5 Drawing Sheets

EXHAUST GAS TURBOCHARGER FOR AN INTERNAL COMBUSTION ENGINE

This is a Continuous-In-Part Application of pending international patent application PCT/EP2008/004807 filed Jun. 14, 2008 and claiming the priority of German patent application 10 2007 029 004.9 filed Jun. 23, 2007.

BACKGROUND OF THE INVENTION

The invention relates to an exhaust gas turbocharger for an internal combustion engine with an exhaust gas turbine including a rotor and a controllable exhaust gas guide section.

DE 103 25 985 A1 discloses a guide apparatus in an exhaust gas guide section of an exhaust gas turbocharger for an internal combustion engine. A flow around the turbine rotor of exhaust gases exiting from the internal combustion engine can be altered by means of the guide apparatus. The guide apparatus has a number of adjustable guide vanes, which are positioned in an inflow channel in the exhaust gas guide section upstream of a rotor chamber in the exhaust gas guide section, in which the turbine rotor is received in a rotatable manner. The guide apparatus has a bearing ring and a contour sleeve, wherein the bearing ring and the contour sleeve are fixed by means of spacer elements in such a manner that a certain first distance between the bearing ring and the contour sleeve is present. Due to the positioning of the spacer elements in the inflow channel, a flow resistance is generated which is opposed to the exhaust gas inflow, whereby efficiency losses of the exhaust gas turbocharger are effected.

It is the principal object of the present invention to reduce efficiency losses, which occur due to the spacer elements positioned in the inflow channel by simple measures.

SUMMARY OF THE INVENTION

In an exhaust gas turbocharger for an internal combustion engine, comprising a turbine rotor, which is rotatably housed in a rotor chamber through which exhaust gas coming from the internal combustion engine is conducted and wherein the flow around the turbine rotor is conditioned by means of a guide apparatus comprising a support ring with rotatably mounted guide vanes. For fixing a first distance (A) between the support ring and the contour sleeve, at least one spacer element with a longitudinal axis, an outer surface and a cross-sectional area is provided so as to have a streamlined shape forming in the exhaust gas flow only a relatively narrow wake line and the spacer element is so arranged that the wake line formed thereby extends essentially through a flow space between two adjacent guide vanes without disturbing the exhaust gas flow around these guide vanes.

A design of the spacer element where a chord length of the spacer element has at least twice the size of a largest profile thickness of the spacer element has been proven to be particularly advantageous.

Preferably, the spacer element is in the form of streamlined sleeve whereby material and weight can be reduced in an advantageous manner.

A flow resistance as small as possible can be adjusted in each operating point of the exhaust gas turbocharger by means of a mounting which can be moved in a rotatable or translational manner. In this way, the best possible efficiency can be achieved in each operating point of the exhaust gas turbocharger.

For further increase of the efficiency, the spacer element is positioned in such a manner that a first trailing wake line caused by the spacer element extends through a channel between a first guide vane and a second guide vane formed adjacent to the first guide vane without an interaction with a boundary layer of the second guide vane. A flow section which is formed downstream of an element flown over has principally to be called a trailing flow. The trailing flow is a flow section formed at the rear edge of a vane-shaped spacer element whose vane tips are arranged in the direction of the flow. This trailing flow influences the flow in the channel formed between two guide vanes. When the trailing flow reaches the boundary layer of a guide vane, the boundary layer becomes wider or is torn off which causes an efficiency loss. This tearing can be avoided by means of the suitable positioning of the spacer element, so that an efficiency increase can be obtained.

A spiral tongue is formed in the exhaust gas guide section at the entry into the spiral channel. In the region of the spiral tongue, a second trailing flow of the exhaust gas flow is formed when the gas flows through the spiral channel is flown through. With a positioning of the spacer element in a region of a second trailing flow, an additional increase of the efficiency can be achieved. The efficiency losses occurring due to the second trailing flow are not or only marginally affected by the positioning of the spacer element in this region. The efficiency increase is determined in that the efficiency losses occurring by means of the spacer element are compensated by the positioning in the region of the second trailing flow.

The distance between the bearing ring and the contour sleeve is ensured over a circumference of the bearing ring by means of at least three spacer elements, which are arranged between the bearing ring and the contour sleeve.

The invention will become more readily apparent from the following description of a particular embodiment thereof with reference to the accompanying drawings.

DESCRIPTION OF PARTICULAR EMBODIMENTS

Figure 1:
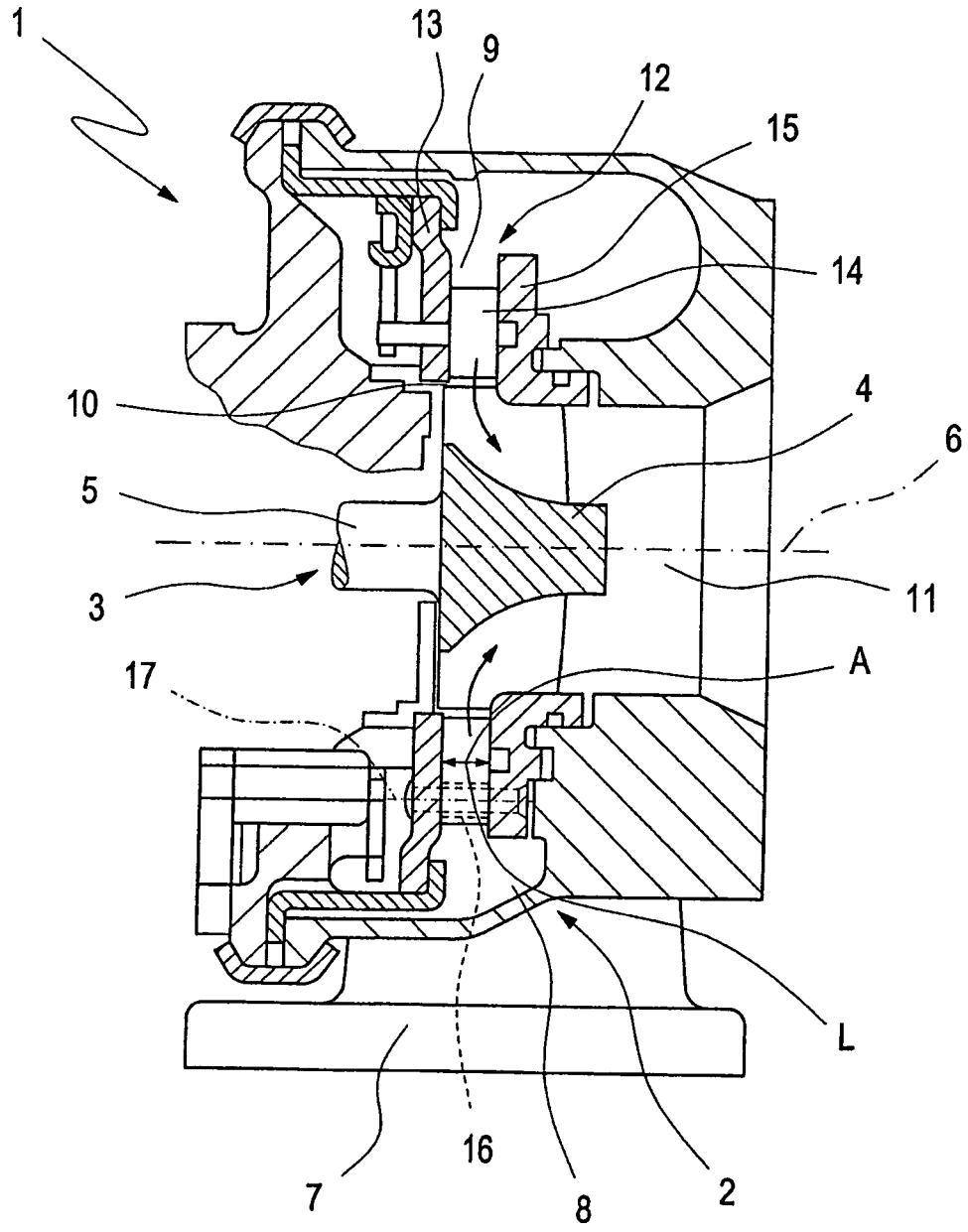
FIG. 1 is a cross-sectional view of an exhaust gas guide section of an exhaust gas turbocharger with a guide apparatus according to the state of the art.

The exhaust gas guide section 2 of an exhaust gas turbocharger 1 through which the exhaust gas flows as shown in FIG. 1 is provided in an exhaust gas tract of an internal combustion engine, not shown in detail, which is a gasoline engine or a Diesel engine. The exhaust gas turbocharger 1 further has a fresh air compressor section, which is not shown but which is arranged in an intake tract of the internal combustion engine, not shown in detail.

The exhaust gas turbocharger 1 has a rotor assembly 3 which comprises a compressor wheel for taking in and compressing combustion air but which is not shown, a turbine rotor 4 for the expansion of exhaust gas, and a shaft 5 with a rotational axis 6 connecting the compressor wheel to the turbine rotor 4 in a rotationally fixed manner. The shaft 5 is mounted rotatably in the bearing section of the exhaust gas turbocharger 1, which is positioned between the air guide section and the exhaust gas guide section 2.

An entry channel 7 is formed in the exhaust gas guide section 2 for guiding the exhaust gas into the exhaust gas guide section 2. The entry channel 7 serves for conditioning the exhaust gas, which brings the turbine rotor 4 into a rotating movement during the operation of the internal combustion engine. The compressor wheel is also rotated by means of the shaft 5, so that it takes in and compresses combustion air.

A spiral channel 8 is arranged downstream of the entry channel 7 in the exhaust gas guide section 2, which spiral channel serves for providing a rotation-symmetrical flow. The spiral channel 8 is further formed as a an exhaust gas guide channel between the entry channel 7 and an inflow channel 9, which is positioned downstream of the spiral channel 8. At the entry into the spiral channel 8, a spiral tongue 20 is formed in the exhaust gas guide section 2. A rotor chamber 10 is arranged in the exhaust gas guide section 2 downstream of the inflow channel 9, in which the turbine rotor 4 is received in a rotatable manner. The exhaust gas guide section 2 has an outlet channel 11 downstream of the rotor chamber 10 for discharging exhaust gas from the exhaust gas guide section 2.

So that an exhaust gas turbocharger efficiency as high as possible can be achieved with low loads and low speeds of the internal combustion engine, and also with high loads and high speeds of the internal combustion engine, the exhaust gas flow can be controlled by means of an adjustable guide apparatus 12, which is arranged in the exhaust gas guide section 2.

FIG. 1 shows a guide apparatus 12 according to the state of the art. The guide apparatus 12 is arranged around the turbine rotor 4 in an annular form and has a support ring 13 for supporting guide vanes 14, which are provided for conditioning the exhaust gas flow. The guide vanes 14 are supported by the bearing ring 13 in a rotatable manner.

The support ring 13 is positioned in the exhaust gas guide section 2 in such a manner that the guide vanes 14 are arranged in the inflow channel 9. A contour sleeve 15 is positioned opposite the bearing ring 13, which sleeve is formed for conditioning the flow and for the simplified mounting of the guide apparatus 12.

Figure 2:
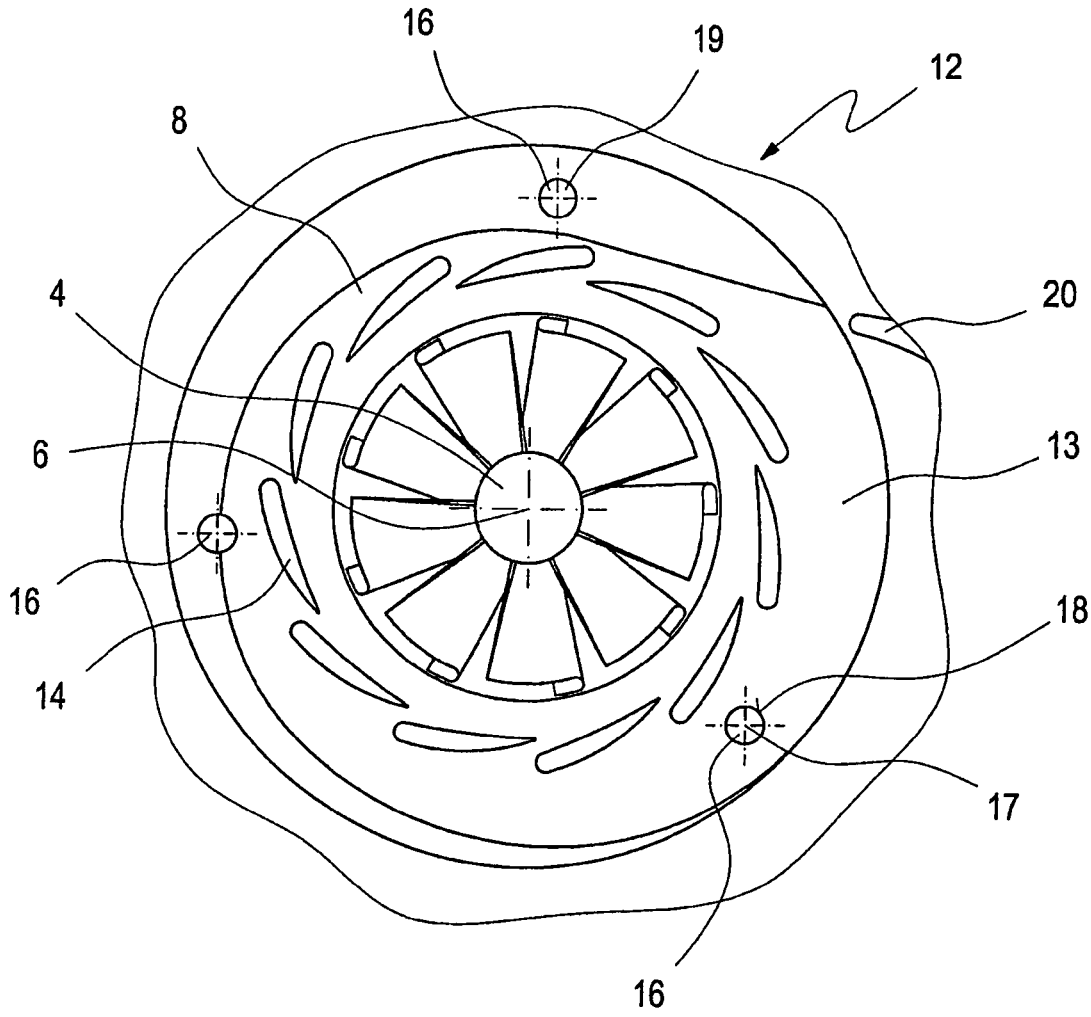
FIG. 2 shows the guide apparatus according to FIG. 1 in plan view.

Spacer elements 16 are positioned in the inflow channel 9 for fixing a first distance A between the contour sleeve 15 and the bearing ring 13, which is necessary for avoiding a canting of the guide vanes 14 when their position is changed. The spacer elements 16 shown in FIG. 2 according to the state of the art are cylindrical.

Figure 3:
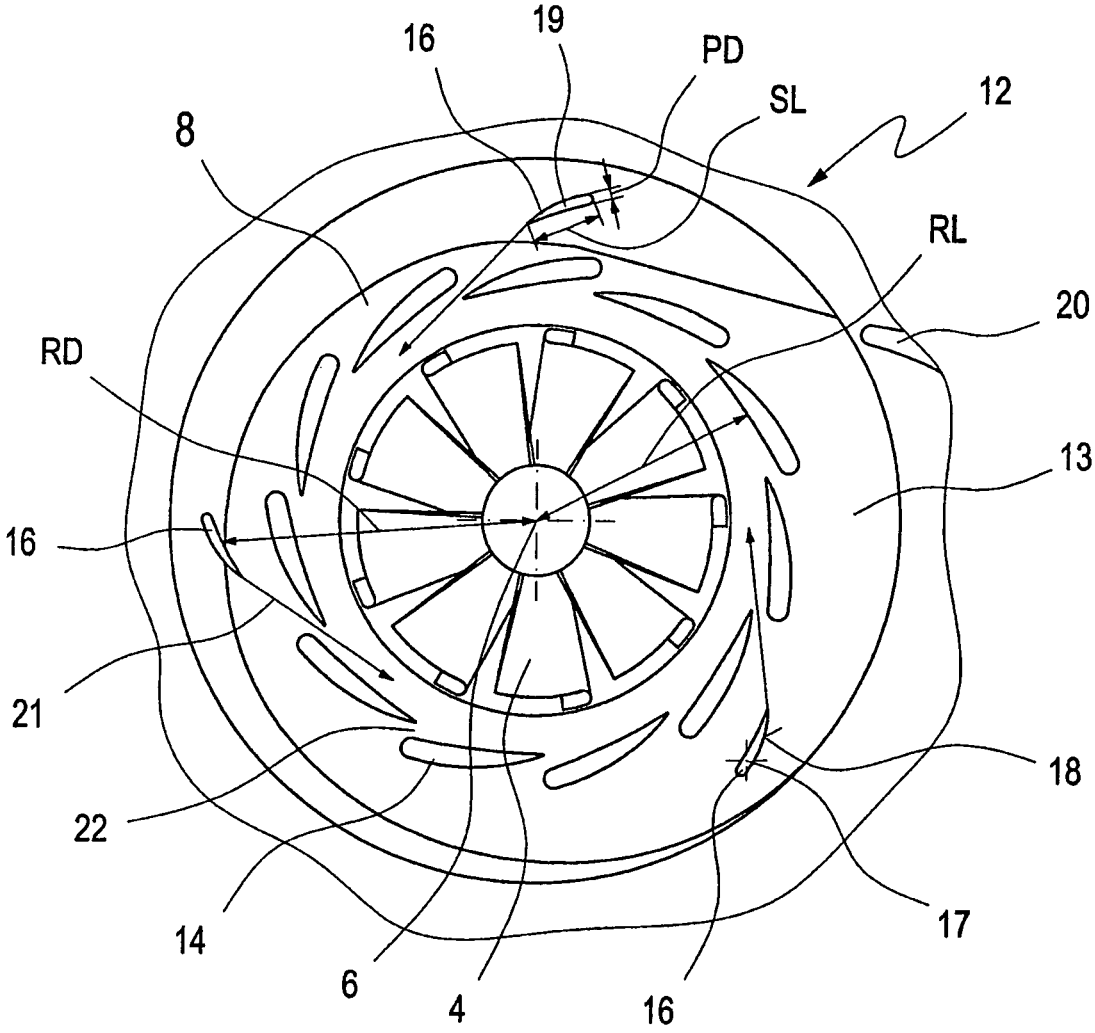
FIG. 3 shows the guide apparatus of an exhaust gas turbocharger according to the invention in plan view, with spacer elements with a preferred outer surface and in a first preferred position
Figure 5:
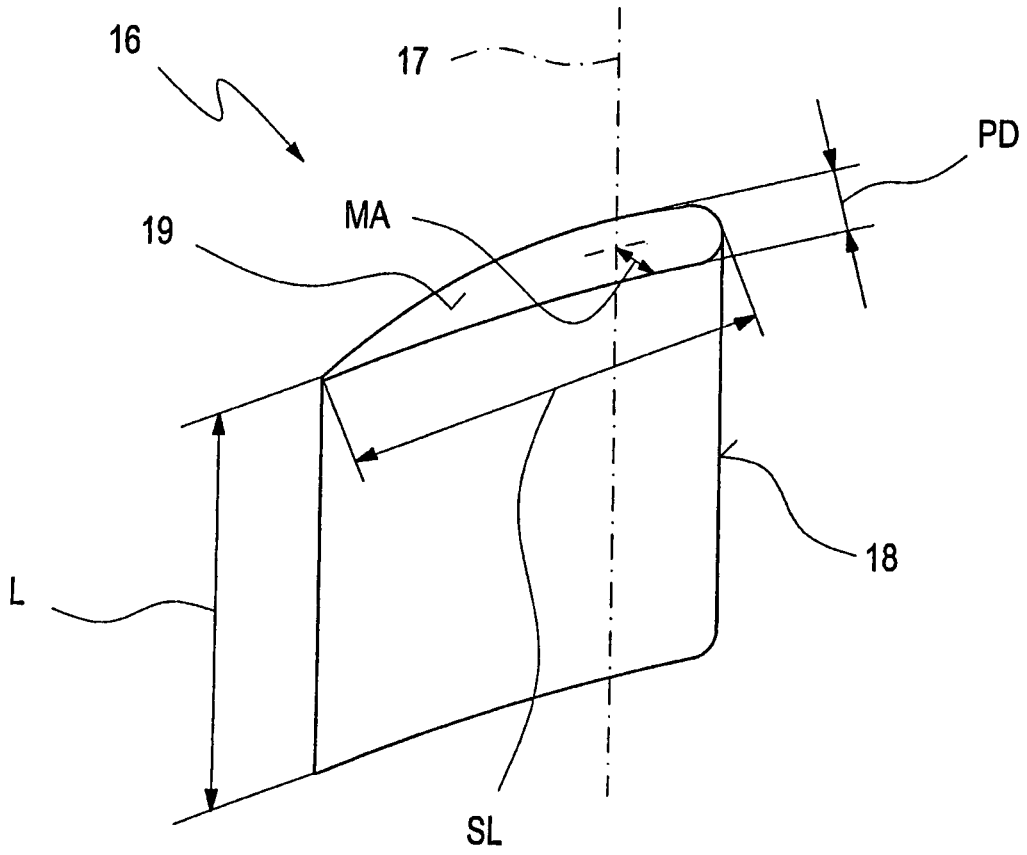
FIG. 5 shows a spacer element of the exhaust gas turbocharger according to the invention in a perspective view.

In FIG. 3, the guide apparatus 12 is depicted in a plan view of the exhaust gas turbocharger 1 according to the invention. The spacer elements 16 have a longitudinal axis 17, an outer surface 18, a length L and a cross-sectional area 19 (see FIG. 5). The spacer elements 16 of the exhaust gas turbocharger 1 according to the invention are designed in an aerodynamic manner, so that the outer surface 18 has a second distance MA from the longitudinal axis 17, which can be changed over the cross-sectional area 19.

In FIG. 3 a preferred cross-sectional area 19 of the spacer element 16 is shown. It has a drop-shaped form similar to a cross-sectional area of a guide vane. The cross-sectional area 19 is a uniform along the longitudinal axis 17. The outer surface 18 could also additionally or exclusively have a changeable second distance MA over the length L, so that the spacer element 16 has for example a symmetrical or asymmetrical, waisted or a bellied contour. In addition to a reduction of the efficiency losses of the exhaust gas turbocharger 1, a uniform flow around the guide vanes 14 is ensured by means of the exhaust gas turbocharger 1 according to the invention. A uniform distribution of adjusting torques of the guide vanes 14 can result therefrom, so that a reduction of the wear of the guide apparatus 12 can be achieved.

Altogether three spacer elements 16 are arranged on the support ring 13 with a third distance RD from the rotational axis 6, which is larger than a fourth distance RL of the guide vanes 14 from the rotational axis 6. The spacer elements 16 are preferably sleeve-shaped. In a further embodiment, at least four spacer elements 16 are provided.

In the embodiment, a chord length SL of the spacer element 16 has about the fourfold size of a largest profile thickness PD of the spacer element 16. The chord length SL should have at least twice the size of the profile thickness PD for effecting an efficiency improvement.

The spacer elements 16 are arranged in a flow-favorable position relative to, the guide vanes 14. The position is chosen in such a manner that a first trailing wake line 21 caused by the spacer element 16 can ideally extend centrally through a channel 22 formed between two adjacent guide vanes 14.

Figure 4:
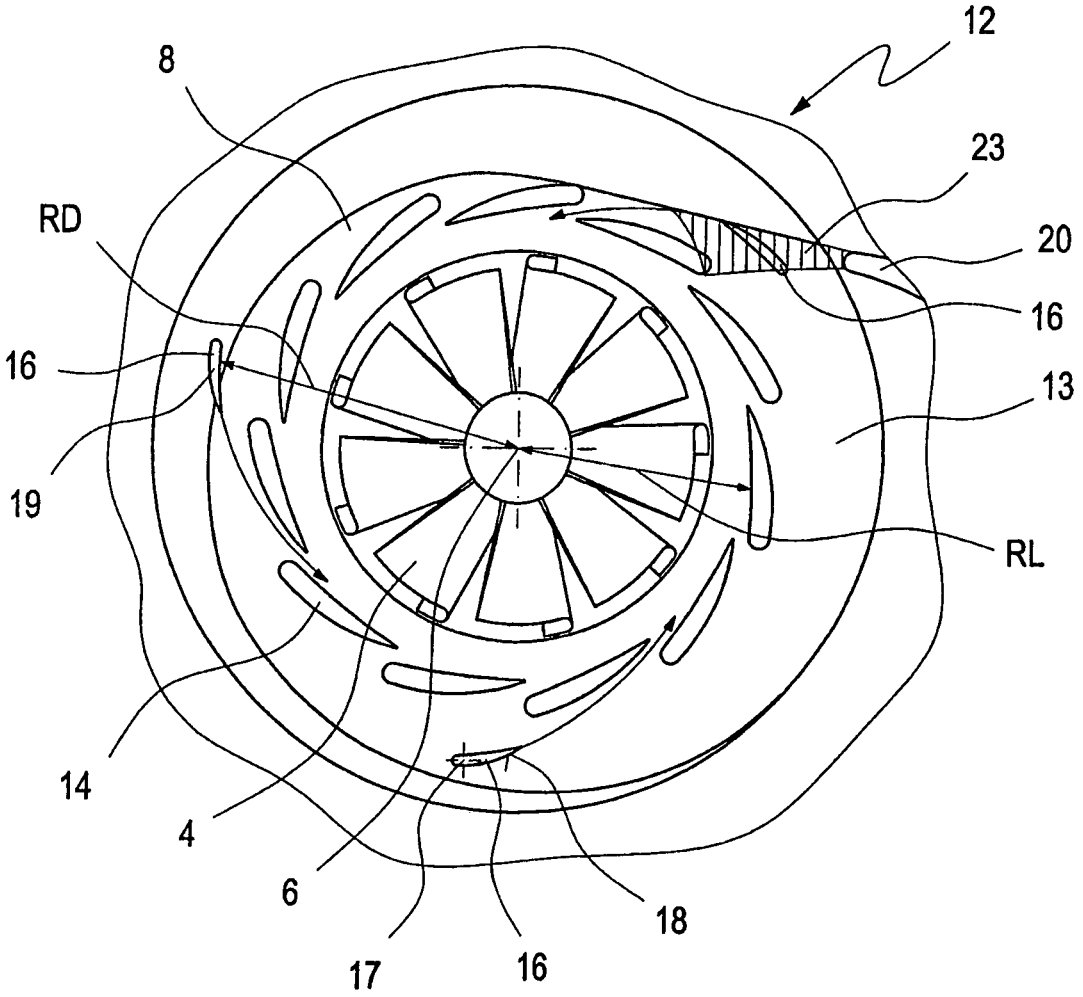
FIG. 4 shows the guide apparatus according to FIG. 3 in plan view, wherein the spacer elements are arranged in a second preferred position.

According to FIG. 4, in a further embodiment for the further efficiency increase, one of the altogether three spacer elements 16 is positioned in the region of a second trailing flow line 23, which is formed in the region of the spiral tongue 20.

As needed, the spacer elements 16 are mounted on the bearing ring 13 in the embodiment. In a further embodiment, the spacer elements 16 are additionally mounted on the contour sleeve 15. In a further embodiment, the spacer elements are only mounted on the contour sleeve 15. In addition to the function of effecting a constant distance between the bearing ring 13 and the contour sleeve 15, a carrier function can also be assigned to the spacer element 16, in the sense that the contour sleeve 15 is carried completely by the spacer element 16 and is positioned or fixed in a radial and axial manner.

In an embodiment, not shown in detail, the spacer elements 16 are mounted in a rotatably or translationally movable manner. The support ring 13 has a groove-shaped, ideally arch-shaped opening for the translational movement of the spacer element 16, in which opening the spacer element 16 is mounted in a displaceable manner. An adjustment device for adjusting the spacer element 16 has to be provided additionally, which has a mechanical construction. The adjustment takes place in dependence on operating values of the internal combustion engine by means of a control unit.

What is claimed is:

1. An exhaust gas turbocharger for an internal combustion engine having a turbine with a rotor chamber (10) and a rotor (4) rotatably disposed in the rotor chamber (10), an exhaust gas guide section (2) which is arranged in an exhaust gas tract of the internal combustion engine and through which exhaust gas discharged from the internal combustion engine is conducted, a guide apparatus (12) arranged around the turbine rotor (4) and comprising a support ring (13) with rotatably mounted guide vanes (14) and a contour sleeve (15), wherein, for fixing a first distance (A) between the support ring (13) and the contour sleeve (15), at least one spacer element (16) with a longitudinal axis (17), an outer surface (18) and a cross-sectional area (19) is provided, the exhaust gas guide section (2) being a spiral channel (8) with a spiral inlet flow guide tongue (20), and the spacer element (16) being positioned in a region positioned radially outside, and spaced from, the guide vanes (14) such that the trailing wake line (21) of the spacer element (16) extends essentially through the center of a flow space between two adjacent guide vanes (14) of the support ring (13) without disturbing the inlet gas flow around the adjacent guide vanes (14), the inlet flow guide tongue (20) forming a guide tongue trailing wake (23) and one of the spacer element (21) being positioned in the region of the inlet flow guide tongue trailing wake (23) such that the trailing wake line (21) of the spacer element (16) coincides with that of the inlet flow guide tongue (20).

2. The exhaust gas turbocharger according to claim 1, wherein the spacer element (16) is elongated and has an outer surface (18) which has a distance (MA) from the longitudinal axis (17), which varies over the cross-sectional area (19) and/or a length (L) of the spacer element (16).

3. The exhaust gas turbocharger according to claim 1, wherein spacer element (16) has a cross-sectional area with a streamlined shape with a chord length (SL) of the spacer element (16) having at least twice the size of a largest profile thickness (PD) of the spacer element (16).

4. The exhaust gas turbocharger according to claim 1, wherein the spacer element (16) is in the form of a sleeve.

5. The exhaust gas turbocharger according to claim 1, wherein the spacer element (16) is mounted in a rotatably or translationally movable manner.

6. The exhaust gas turbocharger according to claim 1, wherein the spacer element (16) is positioned in such a manner that a first trailing wake line (21) initiated by the spacer element (16) extends through a channel (22) formed between two guide vanes (14) arranged adjacent to one another.

7. The exhaust gas turbocharger according to claim 6, wherein the spacer element (16) is positioned in such a manner that a boundary layer of the guide vane (14) is not influenced.

8. The exhaust gas turbocharger according to claim 1, wherein at least three spacer elements (16) are arranged on the support ring (13) for fixing the distance (A) between the bearing ring (13) and the contour sleeve (15).

9. The exhaust gas turbocharger according to claim 1, wherein the spacer element (16) is mounted on the contour sleeve (15) in a movable manner.

10. The exhaust gas turbocharger according to claim 1, wherein the spacer element (16) is connected to the contour sleeve (15) in a fixed manner.

* * * * *